US008592699B2

(12) United States Patent
Kessler et al.

(10) Patent No.: US 8,592,699 B2
(45) Date of Patent: Nov. 26, 2013

(54) SINGLE SUPPORT LEVER KEYBOARD MECHANISM

(75) Inventors: Patrick Kessler, San Francisco, CA (US); Bradley Joseph Hamel, Sunnyvale, CA (US); James J. Niu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 209 days.

(21) Appl. No.: 12/860,547

(22) Filed: Aug. 20, 2010

(65) Prior Publication Data

US 2012/0043191 A1 Feb. 23, 2012

(51) Int. Cl.
*H01H 9/26* (2006.01)
*H01H 13/70* (2006.01)

(52) U.S. Cl.
USPC ..... 200/5 A; 200/343

(58) Field of Classification Search
USPC ..... 200/5 A, 341–345, 296
See application file for complete search history.

(56) References Cited

U.S. PATENT DOCUMENTS

| | | | | |
|---|---|---|---|---|
| 3,974,905 | A | 8/1976 | Johnson | |
| 4,315,114 | A * | 2/1982 | Monti, Jr. | 200/5 A |
| 4,469,461 | A | 9/1984 | Landa | |
| 4,486,637 | A * | 12/1984 | Chu | 200/517 |
| 4,582,967 | A * | 4/1986 | Brumit et al. | 200/5 A |
| 5,481,074 | A | 1/1996 | English | |
| 5,569,889 | A * | 10/1996 | Bruner | 200/5 A |
| 6,027,267 | A * | 2/2000 | Yokobori | 400/479 |
| 7,164,089 | B2 | 1/2007 | Chen | |
| 7,247,806 | B2 * | 7/2007 | Gibbs et al. | 200/296 |
| 7,265,309 | B2 | 9/2007 | Kim et al. | |
| 7,276,671 | B1 * | 10/2007 | Wu | 200/520 |
| 7,381,919 | B1 * | 6/2008 | Yu et al. | 200/296 |
| 7,592,560 | B1 * | 9/2009 | Lai | 200/296 |
| 2006/0096847 | A1 * | 5/2006 | Nishimura et al. | 200/406 |
| 2007/0091070 | A1 * | 4/2007 | Larsen et al. | 345/168 |

OTHER PUBLICATIONS

Balakrishnan, et al., "*Keyswitch Orientation Can Reduce Finger Joint Torques During Tapping on a Computer Keyswitch*," Harvard School of Public Health, Boston, Massachusetts, 2006.

Ecker, "*Keyboard with Toggled Cantilever*," IBM TDB, Sep. 1, 1970.

* cited by examiner

*Primary Examiner* — Xuong Chung Trans

(74) *Attorney, Agent, or Firm* — Brownstein Hyatt Farber Schreck, LLP

(57) ABSTRACT

A keyboard mechanism for a low-travel keyboard and methods of fabrication are described. The low-travel keyboard is suitable for a thin-profile computing device, such as a laptop computer, netbook computer, desktop computer, etc. The keyboard includes a key cap that can be formed of a variety of materials in the form of a flat slab. The key cap is attached to one end of a support lever that supports it from underneath. In one embodiment, the support lever is formed of a rigid material and is pivotally coupled with a substrate on the other end. In another embodiment, the support lever is formed of a flexible material and is fixedly attached to the substrate on the other end. The portion of the support lever that is attached to the key cap is positioned over a metal dome that can be deformed to activate the switch circuitry of the membrane on printed circuit board underneath the dome.

25 Claims, 8 Drawing Sheets

SINGLE SUPPORT LEVER KEYBOARD MECHANISM

BACKGROUND OF THE INVENTION

1. Field of the Invention

The described embodiments relate generally to peripheral devices for use with computing devices and similar information processing devices. More particularly, the present embodiments relate a thin profile, aesthetically pleasing keyboard well suited for use with computing devices, and methods of assembling such thin profile, aesthetically pleasing keyboards.

2. Description of the Related Art

The outward appearance, as well as functionality, of a computing device and its peripheral devices is important to a user of the computing device. In particular, the outward appearance of a computing device and peripheral devices, including their design and heft, is important, as the outward appearance contributes to the overall impression that the user has of the computing device. One design challenge associated with these devices, especially with portable computing devices, generally arises from a number of conflicting design goals, including the desirability of making the device attractive, smaller, lighter, and thinner while maintaining user functionality.

Therefore, it would be beneficial to provide a keyboard for a portable computing device that is aesthetically pleasing, yet still provides the stability for each key that users desire. It would also be beneficial to provide methods for manufacturing the keyboard having an especially aesthetic design as well as functionality for the portable computing device.

SUMMARY OF THE DESCRIBED EMBODIMENTS

This paper describes various embodiments that relate to systems, methods, and apparatus for providing a trapdoor keyboard mechanism for a low-travel footprint keyboard that allows the use of aesthetically pleasing key caps and also provides key stability for use in computing applications.

According to one embodiment, a thin profile keyboard for a computing device is described. The keyboard includes a plurality of keys arranged in a plurality of rows. Each row includes a plurality of keys and the keys in a first row are offset from the keys in a second row. Each key includes a key cap and an actuator attached to a base plate. The actuator is configured to deform to activate electrical switch circuitry when it is deformed. A portion of a rigid support lever is positioned over the actuator, which can be a metal dome. The support lever has one end that is attached to a bottom surface of the key cap and a second end that is attached to a substrate at a pivot point. When a force is applied to the top surface of the key cap, the force causes the support lever to rotate about the pivot point, causing a bottom surface of the support lever to contact and deform the actuator. In an embodiment, the key cap can be in the form of a flat slab. An elastomeric spacer may be provided on the support lever over the metal dome such that the elastomeric spacer deforms the metal dome when the key is depressed by a user. The use of a single support lever allows the key cap to be simply adhered to the support lever and the support lever also reduces instability when the key is depressed by a user. As the key cap can be adhered to the support lever, intricate attachment features on the underside of the key cap are unnecessary, thereby allowing the key cap to be formed of a variety of materials, including glass and metal.

A method of assembling at least a portion of a low-travel keyboard for a computing device is disclosed. The method can be carried out by the following operations: providing a metal dome configured to deform when depressed from above, disposing a support lever over the metal dome, and adhering a key cap to the support lever. The metal dome can activate electrical switch circuitry of the keyboard when the metal dome is deformed. The support lever is coupled with a substrate at a point on a first end of the support lever. The bottom of the key cap is adhered to a top surface of the second end of the support lever, which is positioned over the metal dome to deform the dome when depressed from above. In an embodiment, the support lever is formed of a rigid material and is pivotally coupled to the substrate such that the support lever deforms the metal dome when the support lever is depressed from above, as the support lever rotates slightly about the pivot point where it is coupled to the substrate. In another embodiment, the support lever is formed of a flexible material and fixedly coupled to the substrate on one end.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF SELECTED EMBODIMENTS

Figure 1:
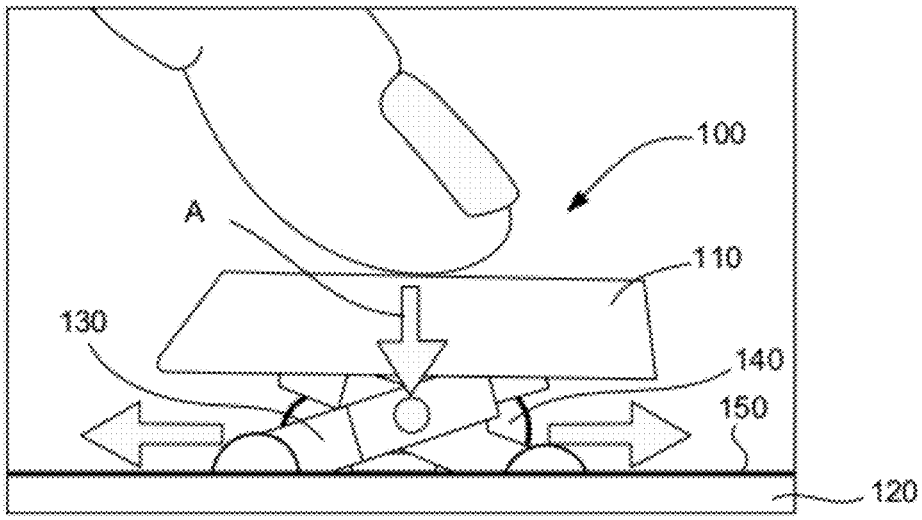
FIG. 1 is a side view of a typical key switch of a scissor-switch keyboard.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

The embodiments herein relate to a thin profile peripheral input device that is both efficient and aesthetically pleasing. In particular, the thin profile peripheral input device can take the form of a keyboard that can include at least a low profile key cap assembly. The low profile key cap assembly can, in turn, be formed of a key cap connected to one end of a beam or lever, the beam or lever having another end pivotally connected to base portion. The key cap can be positioned proximate to a switch mechanism that can be engaged by the key cap impinging thereupon. In one embodiment, the beam can be rigid in nature and formed of, for example, stainless steel, aluminum, or any other suitable material. The rigid beam can be pivotally connected to the base portion at a pivot point using, for example, bushings. In this way, in order to engage the actuator, a force can be applied to the key cap causing the beam and the key cap to rotate about the pivot point resulting in the key cap moving in an arc-like manner. However, due to the relatively long distance between the pivot point and the key cap and the reduced Z stack of the key cap assembly, the angle of rotation of the key cap is small enough and any rotational wobble is substantially reduced.

In another embodiment, the beam can be formed of a more compliant material fixedly connected to the base. In this way, when the force is applied to the key cap, the beam can bend allowing a more compliant feel to the key cap. It should be noted that, in some cases, a compliant material layer formed of, for example, silicone rubber can be positioned between the key cap and the actuator providing a distinctive feel to the key cap. In some cases, this distinctive feel can be customized to a particular application by using various materials. For example, a harder material can provide a more firm feel whereas softer, more compliant materials, such as silicone rubber, a more compliant feel. In this way, it is contemplated that selected key cap assemblies can be fashioned to have their own associated "feel" that can depend upon a number of factors such as a position on the keyboard, function associated with key cap, and so on.

Furthermore, since there is no restriction on the material used to form an observable portion of the key cap, the key caps can be formed to include an upper layer formed of materials heretofore deemed unsuitable for use in keyboards. Such materials as wood, stone, polished meteorite (watch dials have been made from polished meteorite), glass, etc. can be used as opposed to standard key caps that rely on plastic material.

There are several types of keyboards, usually differentiated by the switch technology employed in their operation. The choice of switch technology affects the keys' responses (i.e., the positive feedback that a key has been depressed) and travel (i.e., the distance needed to push the key to enter a character reliably). One of the most common keyboard types is a "dome-switch" keyboard, which works as described below. When a key is depressed, the key pushes down on a rubber dome sitting beneath the key. The rubber dome collapses, which gives tactile feedback to the user depressing the key, and causes a pair of conductive lines on the printed circuit board (PCB) below the dome to contact, thereby closing the switch. A chip in the keyboard emits a scanning signal along the pairs of lines on the PCB to all the keys. When the signal in one pair of lines changes due to the contact, the chip generates a code corresponding to the key connected to that pair of lines. This code is sent to the computer either through a keyboard cable or over a wireless connection, where it is received and decoded into the appropriate key. The computer then decides what to do based on the particular key depressed, such as display a character on the screen, or perform some other type of action. Other types of keyboards operate in a similar manner, with the main difference being how the individual key switches work. Some examples of other keyboards include capacitive keyboards, mechanical-switch keyboards, Hall-effect keyboards, membrane keyboards, roll-up keyboards, and so on.

FIG. 1 is a side view of a typical key switch 100 of a scissor-switch keyboard. A scissor-switch keyboard is a type of relatively low-travel dome-switch keyboard that provides the user with good tactile response. Scissor-switch keyboards typically have a shorter total key travel distance, which is about 1.5-2 mm per key stroke instead of about 3.5-4 mm for standard dome-switch key switches. Thus, scissor-switch type keyboards are usually found on laptop computers and other "thin-profile" devices. The scissor-switch keyboards are generally quiet and require relatively little force to press.

As shown in FIG. 1, the key cap 110 is attached to the base plate or PCB 120 of the keyboard via a scissor-mechanism 130. The scissor-mechanism 130 includes two separate pieces that interlock in a "scissor"-like manner, as shown in FIG. 1. The scissor-mechanism 130 is typically formed of a rigid material, such as plastic or metal or composite material, as it provides mechanical stability to the key switch 100. As illustrated in FIG. 1, a rubber dome 140 is provided. The rubber dome 140, along with the scissor-mechanism 130, supports the key cap 110.

When the key cap 110 is pressed down by a user in the direction of arrow A, it depresses the rubber dome 140 underneath the key cap 110. The rubber dome 140, in turn, collapses, giving a tactile response to the user. The scissor-mechanism 130 also transfers the load to the center to collapse the rubber dome 140 when the key cap 110 is depressed by the user. The rubber dome also dampens the keystroke in addition to providing the tactile response. The rubber dome 140 can contact a membrane 150, which serves as the electrical component of the switch. The collapsing rubber dome 140 closes the switch when it depresses the membrane 150 on the PCB, which also includes a base plate 120 for mechanical support. The total travel of a scissor-switch key is shorter than that of a typical rubber dome-switch key. As shown in FIG. 1, the key switch 100 includes a three-layer membrane 150 (on a PCB) as the electrical component of the switch. The membrane 150 can be a three-layer membrane or other type of PCB membrane, which will be described in more detail below.

The following description relates to a single support lever keyboard mechanism for a low-travel keyboard suitable for a small, thin-profile computing device, such as a laptop computer, netbook computer, desktop computer, etc. The use of a single support lever to support the key cap and to activate the switch circuitry not only allows for the key cap to be formed of almost any material but also provides stability to each key, as will be described in more detail below. The aesthetic appearance of a keyboard therefore depends greatly on the key caps, which form most of the visible portion of a keyboard. It will be understood that the material of the key caps will be important, not only because the key caps are highly visible but also because the material should have a desired tactile feel to a user's fingers.

These and other embodiments of the invention are discussed below with reference to FIGS. 2-8. However, those skilled in the art will readily appreciate that the detailed description given herein with respect to these figures is for explanatory purposes as the invention extends beyond these limited embodiments.

Figure 2:
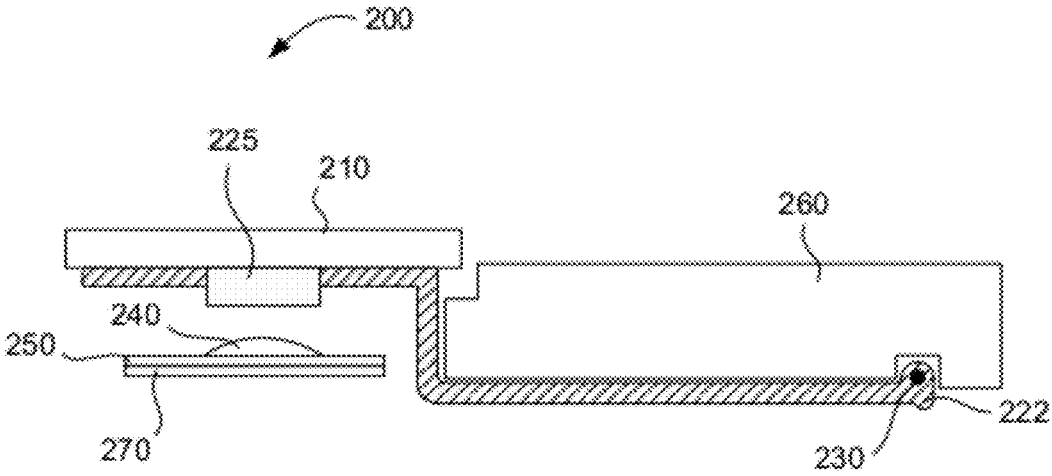
FIG. 2 is a side view of an embodiment of a key having a single support lever.

FIG. 2 is a side view of an embodiment of a key switch 200. As shown in FIG. 2, the key cap 210 in this embodiment is different from standard key caps like the one shown in FIG. 1. The key cap 210 of this embodiment can be a slab of material that is flat. In other words, the key cap has a substantially flat top surface and a substantially flat bottom surface. The key cap 210 does not need to have any features on the underside for attaching any other components of the key 200. The key cap 210 can simply be adhered to a support lever 220. In an embodiment, the key cap 210 can be adhered to the support lever 220 with an adhesive, such as VHB™ double-sided bonding tape, available from 3M Company of St. Paul, Minn.

The keyboard can include a key cap 210, such as the one shown in FIG. 2, positioned over and rigidly attached to a support lever 220. According to embodiments described herein, the key cap 210 can be formed of almost any suitable material, including, but not limited to, wood, stone, polished meteorite, ceramic, metal, and glass. An outer surface of the key cap can also be coated with a non-slip material, such as rubber. The key cap 210 can have a thickness in a range of about 0.5-1 mm. In one embodiment, a glass key cap has a thickness of about 1 mm. According to another embodiment, a ceramic key cap has a thickness of about 0.5 mm. It will be appreciated that the thickness of the key cap 210 may depend on the material of the key cap 210. In some embodiments, the top surface of the key cap 210 is surface-marked. In other embodiments, the key cap 210 can be laser-cut, two-shot molded, engraved, or formed of transparent material with printed inserts 215.

A standard key, such as the one shown in FIG. 1, has a key cap 110 typically formed of a molded plastic material so that the underside of the key cap 110 can include intricate features for attaching the scissor mechanism 130. As described in more detail below, the key cap 210 in the described embodiments can be in the form of a flat slab that is adhered to a support lever 220. Thus, the key cap 210 need not be formed of a moldable plastic material to accommodate intricate attachment features for a scissor mechanism. Instead, the key cap 210 can be formed of other materials, including, but not limited to, glass, wood, stone, and polished meteorite.

According to one embodiment, the support lever 220 can be formed of a rigid material, such as stainless steel or ceramic. Stainless steel has a number of characteristics that make it a good choice for the support lever 220. For example, stainless steel is rigid, durable and fairly resistant to corrosion, and it is a relatively inexpensive metal that can be easily machined and has well known metallurgical characteristics. Furthermore, stainless steel can be recycled. According to an alternative embodiment, the support lever 220 is formed of a ceramic material.

According to some embodiments, the support lever 220 is fixedly attached at one end to the underside of the key cap 210. The fixed attachment provides rotational stability to the key 200 because there is essentially only one moving part when the key cap 210 is depressed by a user. In other words, the support lever 220 and the attached key cap 210 together form the single moving part. A standard key, such as the one shown in FIG. 1, typically has three moving parts: the key cap 110 and the two linked parts of the scissor mechanism 130.

The rigid support lever 220 provides stability to the key by reducing wobble from side to side. The key 200 may rotate slightly forward when depressed, which may be ergonomically desirable. However, such slight rotation is virtually imperceptible for low-travel keys, as is described in more detail below. As shown in FIG. 2, a single support lever 220 supports the key cap 210.

The support lever 220, which, on one end, has its top surface attached to the underside of the key cap 210, can also dictate the height of the key cap 210 or the distance between the key cap 210 and the base plate 270. In the embodiment shown in FIG. 2, the support lever 220 has an upper portion in a plane and a lower portion in a lower plane, and the upper portion and the lower portion are connected by a portion in a plane perpendicular to the planes of the upper and lower portions. The other end of the support lever 220, which is on the lower portion, is pivotally coupled with the topcase 260, as described in more detail below. It will be understood that the topcase 260 is the portion of the housing or substrate surrounding the keys. In the event the key cap 210 is depressed in an off-center manner, the support lever 220 transfers the load to the center of the key. According to an embodiment, the support lever 220 is formed of steel and has a thickness of about 0.5 mm.

In this embodiment, the support lever 220 is formed of a rigid material and rotatably or pivotally coupled, at its other lower end, with the topcase 260 at a pivot point at a distance from the key cap 210. In some embodiments, the distance is about one key pitch. As illustrated in FIG. 2, a bearing 222 is positioned at the lower end of the support lever 220. The distance between the bearing 222 and the key cap 210 can be dictated by the pitch between the rows of keys. As the skilled artisan will appreciate, the distance, and therefore the length of the support lever 220, can be limited by the space available and depends on the size of the device and the individual key caps 210. In some embodiments, the distance between the bearing 222 and the key cap 210 can be in a range of about 25-30 mm. As shown in FIG. 2, the bearings 222 are positioned underneath the topcase 260 of the device.

As shown in FIG. 2, the end of the support lever 220 that is attached to the key cap 210 is higher than the end that is pivotally coupled with the topcase 260 at the bearing 222. In the embodiment shown in FIG. 2, the bearings 222 are integrally formed with the support lever 220. In other embodiments, the bearings 222 can be rigidly attached to the support lever 220. The skilled artisan will understand that such a configuration of the support lever 220 and the attachment of the key cap 210 to a single support lever 220 allows the support lever 220 to rotate slightly when the key cap 210 is pushed down by a user. In an embodiment where the bearing 222 is located closer to the user than the key 200, the support lever 220 will rotate slightly forward when the key cap is depressed. Such a forward rotation during key travel can be ergonomically desirable. For low travel keyboards, such rotation can be almost imperceptible.

According to some embodiments, the keys 200 are low-travel keys that have a total travel in a range of about 0.2 mm to about 1.85 mm. In other embodiments, the keys have a total travel in a range of about 0.2 mm to about 0.5 mm.

Figure 3:
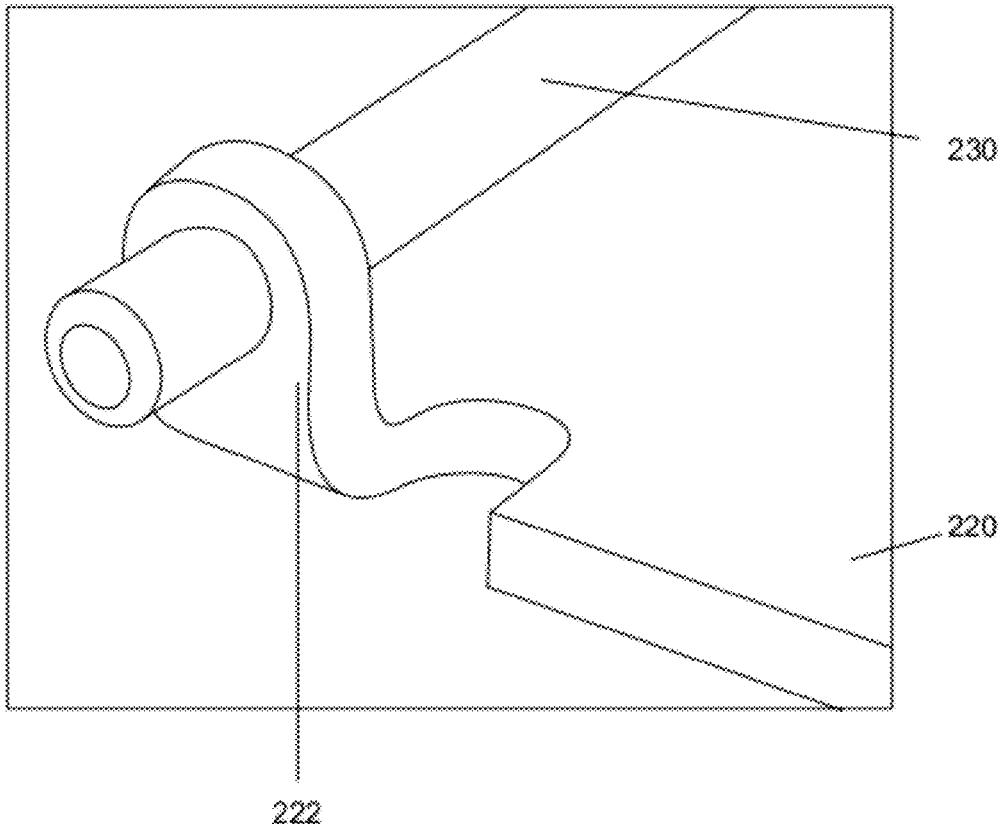
FIG. 3 is a detailed view of an embodiment of the pivoted attachment of the support lever to the topcase.

FIG. 3 is a detailed view of an embodiment of the pivoted coupling of the support lever 220 to the topcase 260. In this embodiment, the support lever 220 has a pair of bearings 222 through which a dowel pin 230 threaded. According to this embodiment, the dowel pin 230 acts as the pivot axis about which the support lever 220 pivots or rotates. In an embodiment, the dowel pin 230 can be fixedly coupled to the topcase 260 using snaps that trap the dowel pin 230 in its bearing such that it can simply be pressed in during assembly. In another embodiment, the bearings can be pressed onto the ends of the dowel pin 230 and the assembly of the dowel pin 230 and two bearings can be trapped in a recess in the topcase 260. According to some embodiments, the dowel pin 230 can have a diameter in a range of about _ mm to _ mm. In one embodiment, the dowel pin 230 has a diameter of about 0.8 mm.

According to another embodiment, the support lever 220 is formed of a flexible material that can be fixedly adhered to the underside of the key cap 210 on its upper end and is fixedly attached to the topcase 260 at the lower end. In this embodiment, the support lever 220 can be formed of spring steel and does not rotate about a pivot point. Instead, the flexible nature of the support lever material allows a similar motion when the key is depressed, like a linear flex-spring.

As shown in FIG. 2, the support lever 220 can include a compliant component, such as an elastomeric spacer 225, between the key cap 210 and a metal dome 240 positioned underneath the elastomeric spacer 225. The elastomeric spacer 225 may be formed of an extremely compliant material, such as rubber or silicone rubber. The compliant nature of the elastomeric spacer 225 can provide a desirable and distinctive feel to the user when the key is depressed. The elastomeric spacer 225 also reduces rattle of the keyboard by being in constant mild compression and also improves overall sensitivity to tolerance variation during assembly. As described in more detail below, the elastomeric spacer 225 contacts and collapses the metal dome 240 to activate the switch circuitry. The metal dome 240 therefore acts as an actuator.

As illustrated in FIG. 2, a metal dome 240 is positioned over the membrane 250 and the base plate 270. The metal dome 240 can be formed of a material, such as stainless steel. As noted above, stainless steel is durable and fairly resistant to corrosion, and it is a relatively inexpensive metal that can be easily machined and has well known metallurgical characteristics. In some embodiments, the stainless steel metal dome can be plated with gold, silver, or nickel.

The skilled artisan will appreciate that it is desirable to make the keyboard (and computing device) thinner, but users still want the tactile feel to which users are accustomed. It is desirable for the keys to have some "bounce-back" or "snappy" feel. As can be appreciated by the skilled artisan, substantially flat keyboards, such as membrane keyboards, do not provide the tactile feel that is desirable for a keyboard. Similarly, simply reducing the travel of a typical rubber dome scissor-switch keyboard also reduces the tactile or "snappy" feel that a conventional dome-switch keyboard provides.

Metal domes can provide very low travel as well as a crisp tactile feel. Like a rubber dome, a metal dome also dampens the keystroke in addition to providing a very crisp tactile response to the user. A metal dome typically has a good tactile force drop with a relatively short travel distance, which is typically about 0.1-0.2 mm.

The skilled artisan will appreciate that a metal dome has a quick force drop over a short travel distance relative to an elastomeric dome. Elastomeric domes lack the quick force drop and therefore the crisp snap of metal domes. Thus, elastomeric domes do not provide the positive crisp tactile response of metal domes, especially when the amount of travel is reduced. However, although a metal dome can provide a positive crisp tactile feel, a metal dome alone cannot provide the desired tactile feel and travel distance for a keyboard suitable for typing or otherwise inputting text. The skilled artisan will appreciate that a metal dome cannot achieve travel greater than about 0.7 mm, as the metal is difficult to deform and would require a large amount of force for deformation. Even if enough force were applied to the metal dome, it would not be able to achieve a travel distance greater than about 0.7 mm unless the metal dome is quite large. A larger metal dome would cause each individual key to also be quite large, which can be undesirable and impractical, especially in portable devices.

According to some embodiments, the support lever 220 can be provided with an elastomeric spacer 225, as shown in FIG. 2. The elastomeric spacer 225 can be positioned over a metal dome 240 such that the elastomeric spacer 225 contacts the top surface of the metal dome 240 when the key cap 210 is depressed by a user. The elastomeric spacer 225 can be formed of a compliant material, such as silicone rubber, and increases the travel distance of the key 200. As discussed above, the metal dome 240 typically has a relatively short travel distance, but provides crisp, tactile feedback to the user, but the elastomeric spacer 225 can increase the travel distance, which can be desirable, and also provide the tactile feedback to which users have become accustomed. Thus, the combination of the elastomeric spacer 225 with the metal dome 240 allows the key to have a low-travel distance while maintaining the positive tactile feedback that is desirable for a keyboard. The elastomeric spacer 225 also allows for easier assembly of the keys 200, as the assembly tolerance is less sensitive with the inclusion of the elastomeric spacer 225. The elastomeric spacer 225 also provides the further benefit of reducing rattling in the keyboard.

As shown in FIG. 2, the metal dome 240 is substantially concave or hemispherical and oriented with the vertex of each of the dome being at the highest point. In other words, the metal dome opening is facing downward. As the dome 240 is concave, it is a normally-open tactile switch. The switch only closes when the dome 240 is collapsed, as will be described in more detail below.

In this embodiment, the elastomeric spacer 225 also provides the ability for longer travel. The metal dome 240 provides the majority of the tactile force drop and also activates the switch circuitry of the membrane 250 on the base plate 270. The abrupt or quick force drop of the metal dome 240 provides the crisp "snappy" feel for the user. It provides the kind of force drop that the metal dome allows, and also the initial compliancy and force build-up that are absent in metal domes.

When a user presses down on the key cap 210, it causes the support lever 220 to which the key cap 210 is rigidly attached to rotate slightly and move downward. As the support lever 220 moves downward, the elastomeric spacer 225 contacts and collapses the elastomeric dome 220. As shown in FIG. 2, the elastomeric spacer 225 is positioned directly over the center of the top of the metal dome 240. Thus, when the support lever 220 moves downward, the elastomeric spacer 225 then contacts and pushes down on the center of the top of the metal dome 240, and collapses the metal dome 240. As shown in FIG. 2, the elastomeric spacer 225 does not contact the metal dome 240 when the key cap 210 is not depressed. The underside of the center of the collapsing metal dome 240 contacts the top side of the top layer 252 (FIG. 7) of the membrane 250, thereby causing the contact pads 258 of the circuit traces (FIG. 7) on the top layer 252 (FIG. 7) and the bottom layer 256 (FIG. 7) of the membrane 250 to connect and close the switch, which completes the connection to enter the character. As shown in FIG. 2, the membrane 250 is secured to a base plate or PCB 270.

According to an embodiment, the support lever 220 has a thickness of about 0.5 mm. In other embodiments, the support lever may have a thickness that is less than 0.5 mm. In some embodiments, the elastomeric spacer can have a thickness in a range of about 0.3 to 1 mm. In other embodiments, the elastomeric spacer can have a thickness in a range of about 0.5 to 1 mm. The metal dome 240 can have a height in a range of about 0.3 mm to about 0.7 mm. According to another embodiment, the metal dome 240 has a height in a range of about 0.3 mm to about 0.5 mm. In still another embodiment, the metal dome 240 has a height in a range of about 0.5 mm to about 0.7 mm.

In an embodiment, the metal dome 240 has a thickness in a range of about 0.03 mm to about 0.1 mm. It will be understood that the metal dome 240 typically has a uniform thickness if it is formed from a sheet of metal. The skilled artisan will appreciate that the thicknesses of the dome 240 and elastomeric spacer 225 can be adjusted and/or varied to obtain the desired force drop. The base diameter of the dome 240 can be in the range of about 3 mm to 7 mm.

According to an embodiment, as shown in FIG. 2, the metal dome 240 can be secured, at its base in its non-concave portions, to the membrane 250 by means of adhesive, including pressure-sensitive adhesive tape. In an alternative embodiment, the metal dome 240 is not adhered to the membrane 250, but is instead encapsulated by an additional membrane sheet that extends over the metal dome 240 and is adhered to the membrane 250.

Figure 4:
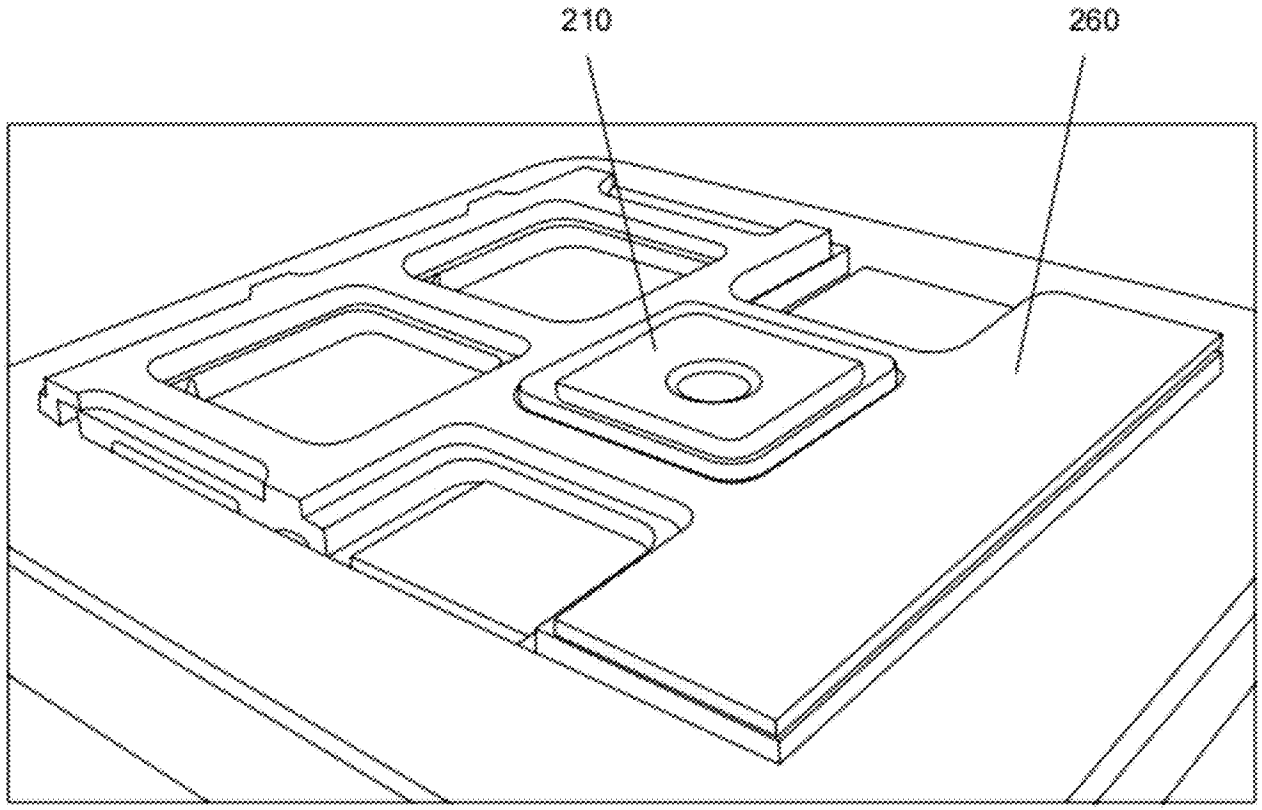
FIG. 4 is a simplified top perspective view of a key cap 210 positioned in an embodiment of the topcase.

FIG. 4 is a simplified top perspective view of a key cap 210 positioned in an embodiment of the topcase 260. For simplicity, FIG. 4 shows only a single key cap 210 and only a portion of the topcase 260. As illustrated, keys are positioned in the topcase 260 of this embodiment in a staggered manner. That is, the rows of keys can be slightly shifted so that keys in one row are not positioned directly below the keys in the row above. The skilled artisan will appreciate that the keys can be arranged in any manner that is desired.

Figure 5:
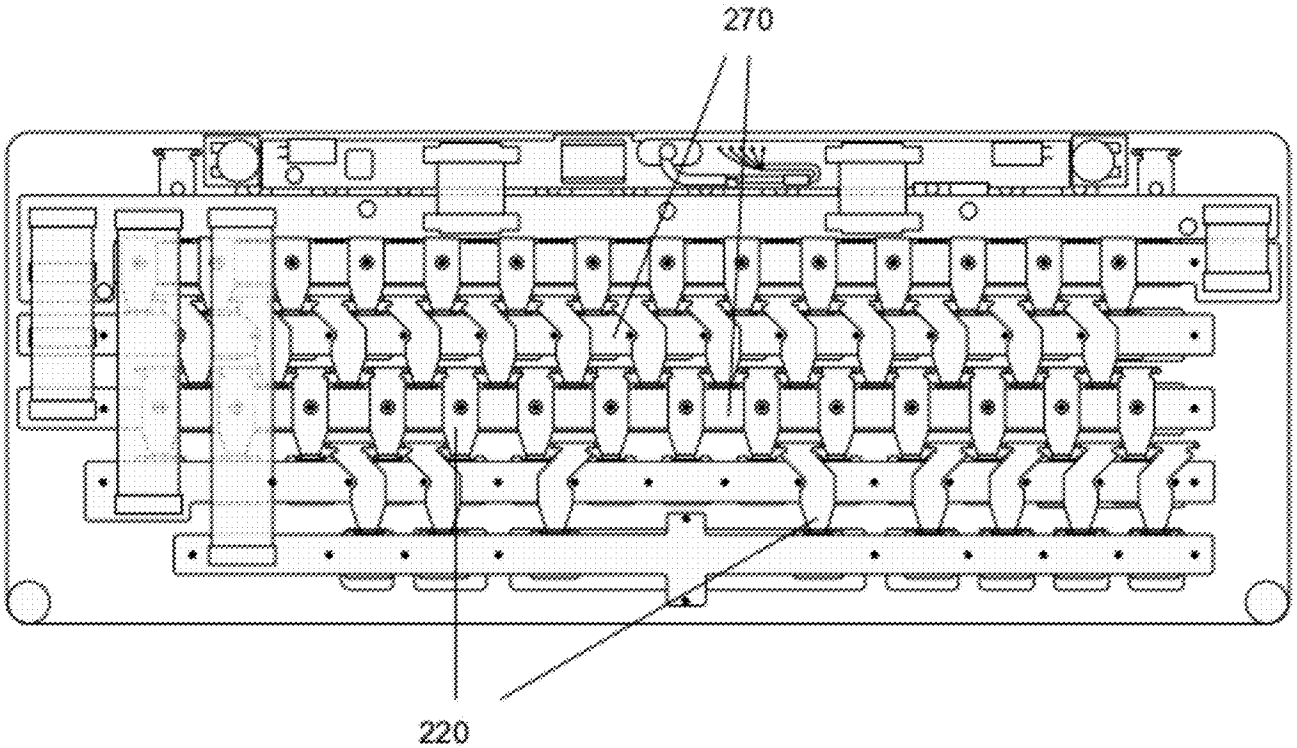
FIG. 5 is a bottom plan view of an embodiment of a keyboard arrangement.
Figure 6:
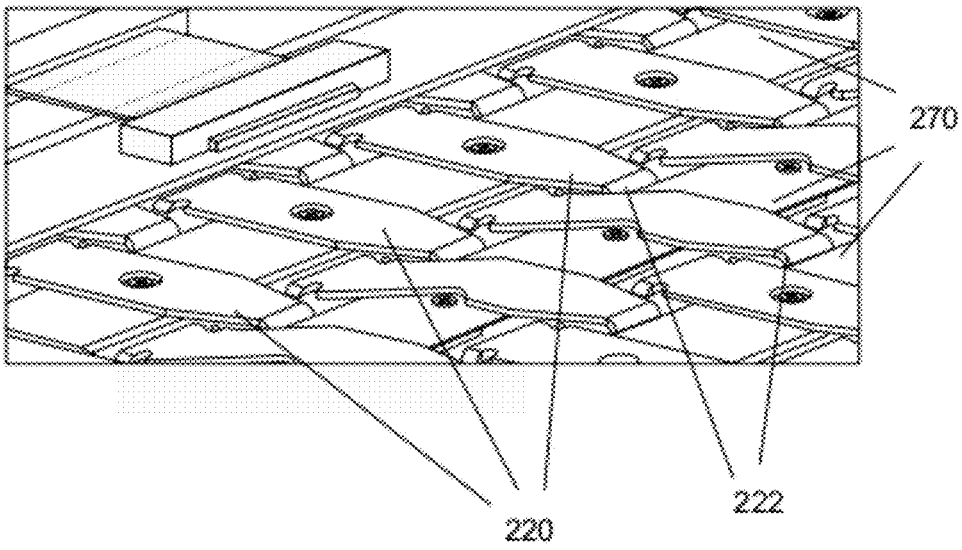
FIG. 6 is a detailed perspective view of the bottom of the keyboard arrangement shown in FIG. 5.

FIG. 5 is a bottom plan view of an embodiment of a keyboard arrangement. FIG. 6 is a detailed perspective view of the bottom of the keyboard arrangement shown in FIG. 5. As shown in FIG. 5, the base plate 270 is arranged in rows across the keyboard. The base plate 270 can be a rigid printed circuit board (PCB). As shown in the embodiments of FIGS. 5 and 6, the base plate 270 and the support levers 220 can be interwoven. It will be understood that the keys 200 of the keyboard can be arranged in any manner that is desired and that the components of the keys 200 can similarly be arranged in any manner such that they fit in the available space. For example, the support lever 220 for some keys can be curved, as illustrated in FIG. 5, to accommodate the different positions of the keys and to conform to an existing keyboard arrangement.

Figure 7:
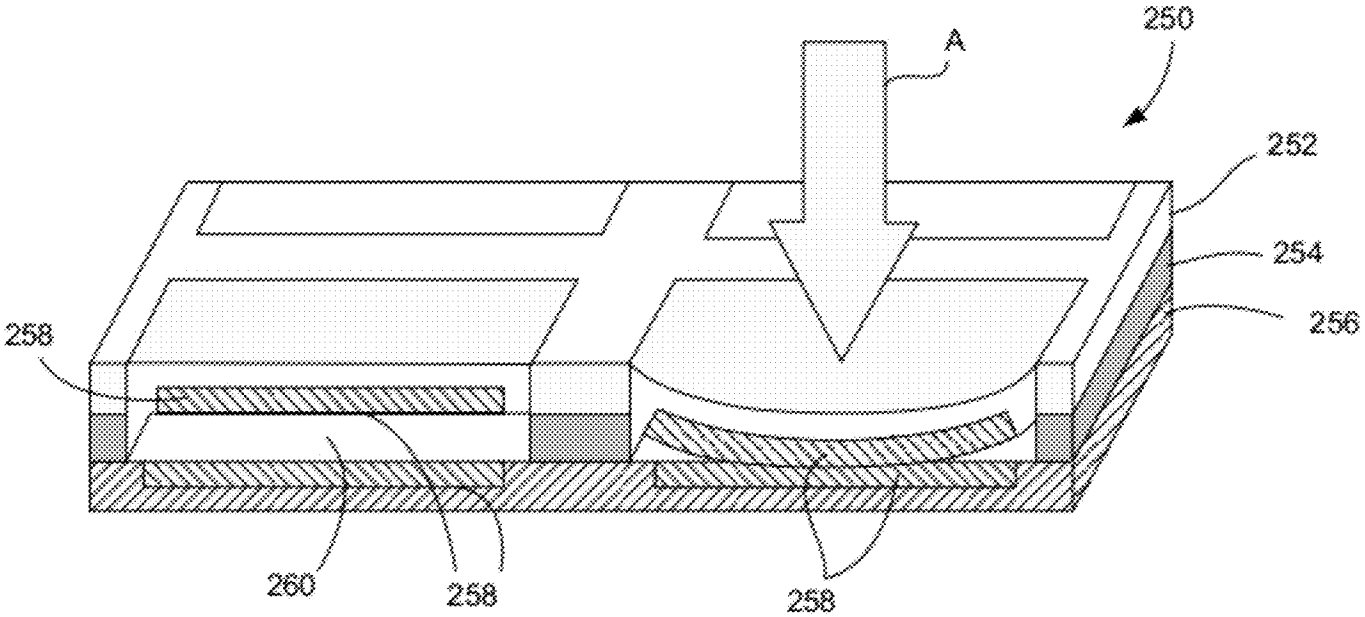
FIG. 7 is a detailed perspective view of an embodiment of a three-layer membrane of a printed circuit board.

FIG. 7 is a detailed perspective view of an embodiment of the membrane 250. According to an embodiment, the membrane 250 can have three layers, including a top layer 252, a bottom layer 256, and a spacer layer 254 positioned between the top layer 252 and the bottom layer 256. The top layer 252 and the bottom layer 256 can include conductive traces and their contact pads 258 on the underside of the top layer 252 and on the top side of the bottom layer 256, as shown in FIG. 7. The conductive traces and contact pads 258 can be formed of a metal, such as silver or copper. As illustrated in FIG. 7, the membrane sheet of the spacer layer 254 includes voids 260 to allow the top layer 252 to contact the bottom layer 256 when the metal dome 240 is collapsed. According to an embodiment, the top layer 252 and bottom layer 256 can each have a thickness of about 0.075 μm. The spacer layer 254 can have a thickness of about 0.05 μm. The membrane sheets forming the layers of the membrane 250 can be formed of a plastic material, such as polyethylene terephthalate (PET) polymer sheets. According to an embodiment, each PET polymer sheet can have a thickness in the range of about 0.025 mm to about 0.1 mm.

Under "normal" conditions when the key pad is not depressed by a user (as shown on the left side of FIG. 7), the switch is open because the contact pads 258 of the conductive traces are not in contact. However, when the top layer 252 is pressed down by the metal dome 240 in the direction of arrow A (as shown on the right side of FIG. 7), the top layer 252 makes contact with the bottom layer 256. The contact pad 258 on the underside of the top layer 252 can then contact the contact pad 258 on the bottom layer 256, thereby allowing the current to flow. The switch is now "closed", and the computing device can then register a key press, and input a character or perform some other operation. It will be understood that other types of switch circuitry can be used instead of the three-layer membrane 250 described above.

Figure 8:
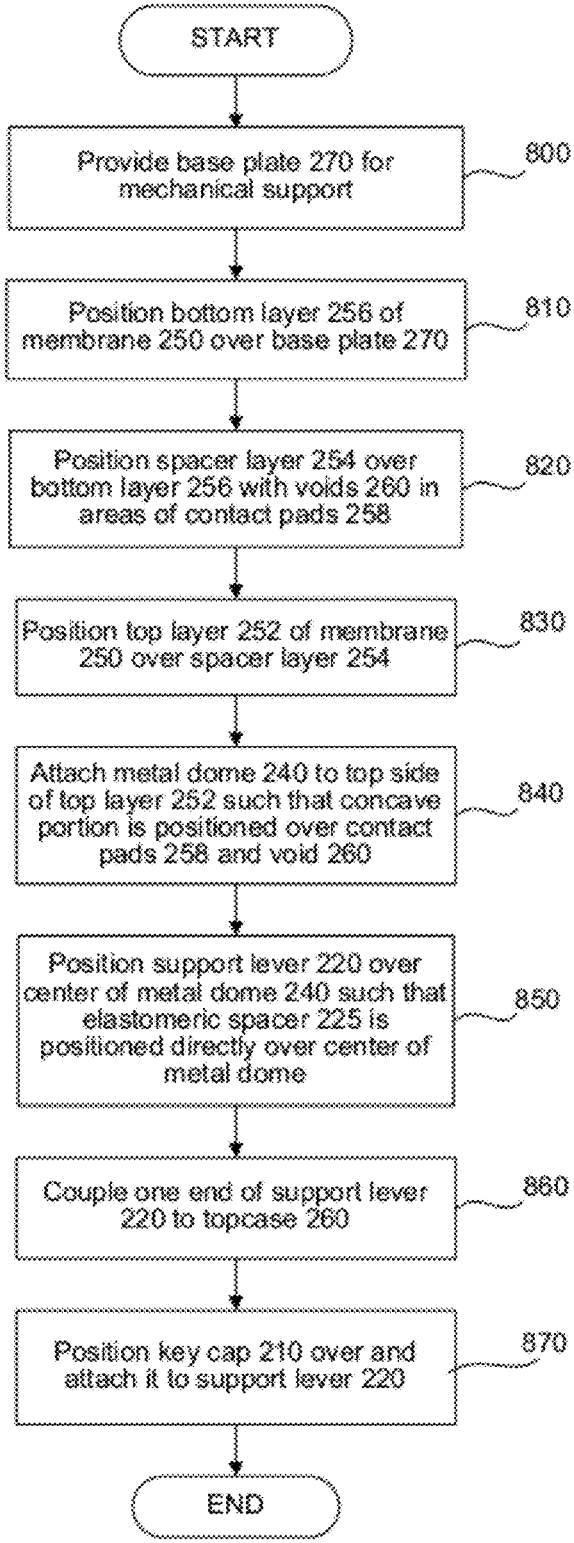
FIG. 8 is a flow chart of a method of assembling an embodiment of a key switch having a single support lever.

A process for assembling the key switch 200, such as the one shown in FIG. 2, will be described with reference to FIG. 8. A process for assembling the components of the key switch 200 will be described below with reference to steps 800-870. In step 800, a base plate 270 is provided for mechanical support for the PCB as well as the entire key switch 200. In one embodiment, the base plate 270 is formed of stainless steel. In other embodiments, the base plate 270 can be formed of aluminum. According to an embodiment, the base plate 270 has a thickness in a range of about 0.2 mm to about 0.5 mm.

A process for forming the three-layer membrane 250 on the base plate 270 will be described below with reference to steps 810-830. In step 810, the bottom layer 256 of the membrane 250 can be positioned over the base plate 270. Next, in step 820, the spacer layer 254 can be positioned over the bottom layer 256 such that the voids 260 are in the areas of the contact pads 258. In step 830, the top layer 252 can be positioned over the spacer layer 254 such that the contact pads 258 on the underside of the top layer 252 are positioned directly over the contact pads 258 on top side of the bottom layer 256 so that they can contact each other when the metal dome 240 is deformed. The layers 252, 254, 256 can be laminated together with adhesive. It will be understood that steps 810-830 can be combined into a single step by providing a three-layer membrane 250 that is pre-assembled or pre-laminated. The membrane 250 is positioned over the base plate 270 and held in place by one or more other components of the key switch 200, such as the scissor mechanism 230.

According to this embodiment, in step 840, the metal dome 240 can be attached to the top side of the top layer 252 of the membrane 250 such that the concave dome portion is positioned over the contact pads 258 and the void 260. In step 850, the support lever 220 is positioned over the metal dome such that the elastomeric spacer 225 is positioned directly over the center of the metal dome 240. In step 860, the support lever 220 is coupled to the topcase 260 at a point at a distance from the key switch 200. In an embodiment, the support lever 220 may be formed of a rigid material and has bearings 222 and the support lever 220 is pivotally coupled, at one end, to the topcase 260 at the point so that the support lever 220 can rotate slightly when a downward force is applied from above. In another embodiment, the support lever 220 may be formed of a flexible material and is fixedly coupled, at one end, to the topcase 260. In this embodiment, in step 870, to complete the key switch 200, the key cap 210 is positioned over and attached to the support lever 220. According to an embodiment, the underside of the key cap 210 can be adhered to the top side of the support lever 220.

The advantages of the invention are numerous. Different aspects, embodiments or implementations may yield one or more of the following advantages. One advantage of the invention is that a low-travel keyboard yet may be provided for a thin-profile computing device without compromising the tactile feel of the keyboard.

The many features and advantages of the described embodiments are apparent from the written description and, thus, it is intended by the appended claims to cover such features and advantages. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A thin profile keyboard for a computing device, comprising:

a plurality of baseplates arranged in a plurality of rows; and a plurality of keys, each of the plurality of keys associated with one of the plurality of baseplates, wherein the plurality of keys associated with a first baseplate are offset from the plurality of keys associated with a second baseplate, each key comprising:

a key cap;

an actuator attached to the respective baseplate, the actuator being configured to deform to activate electrical switch circuitry; and a rigid support lever having a first end attached to a bottom surface of the key cap and a second end attached to a substrate at a pivot point, wherein a portion of the support lever is positioned over the actuator and wherein when a force is applied to a top surface of the key cap, the force causes the support lever to rotate about the pivot point, causing a bottom surface of the support lever to contact and deform the actuator, wherein the rigid support lever at least partially underlies at least one of the plurality of baseplates.

2. The keyboard of claim 1, wherein the actuator is a metal dome for providing a low-travel keystroke having an abrupt force drop.

3. The keyboard of claim 2, wherein the low-travel keystroke has a travel distance that is less than about 1.85 mm.

4. The keyboard of claim 2, wherein the low-travel keystroke has a travel distance that is in a range of about 0.2 mm to about 0.5 mm.

5. The keyboard of claim 1, wherein the top surface of the key cap is substantially flat and the bottom surface of the key cap is substantially flat.

6. The keyboard of claim 5, wherein the key cap is formed of glass.

7. The keyboard of claim 5, wherein the key cap is formed of metal.

8. The keyboard of claim 1, wherein the support lever comprises an elastomeric spacer configured to contact the actuator only when the force is applied to the top surface of the key cap.

9. A method of assembling at least a portion of a low-travel keyboard for a computing device, comprising:

providing a first and second baseplate;

providing a metal dome above the first baseplate, the metal dome configured to deform when depressed from above, wherein the metal dome is configured to activate electrical switch circuitry of the keyboard when the metal dome is deformed;

disposing a support lever over the metal dome, wherein the support lever is coupled with a substrate at a point on a first end of the support lever; and adhering a bottom surface of a key cap to a top surface of a second end of the support lever, wherein the second end of the support lever is positioned over the metal to deform the dome when depressed from above; wherein the support lever is positioned to at least partially underlie the second baseplate.

10. The method of claim 9, wherein the support lever is formed of a rigid material and pivotally coupled with the substrate, wherein the support lever is configured to pivot about the point when depressed from above.

11. The method of claim 9, wherein the support lever is formed of a flexible material and fixedly attached at the first end to the substrate.

12. The method of claim 9, further comprising providing a compliant component on the support lever, wherein the compliant component is positioned directly over the metal dome and configured to contact the metal dome when the support lever is depressed from above.

13. The method of claim 9, wherein a total travel distance of the keyboard is less than 1.85 mm.

14. The method of claim 9, wherein the key cap is formed of a slab of material.

15. The method of claim 9, wherein the electrical switch circuitry is in a membrane disposed below the metal dome, wherein the membrane comprises conductive traces.

16. The method of claim 15, wherein the membrane comprises a top layer, a spacer layer, and a bottom layer.

17. The method of claim 16, wherein the top layer contacts the bottom layer when the metal dome is deformed.

18. A thin-profile keyboard for a computing device having a plurality of key switches arranged in a plurality of rows, each key switch comprising:

a portion of a membrane including electrical switch circuitry;

a metal dome disposed over the membrane and configured to deform to activate the electrical switch circuitry;

a single support lever having:

a first end coupled to a first substrate;

a second end of the support lever disposed over the metal dome;

a first planar segment extending from the first end, the first planar segment at least partially underlying a second substrate;

a second planar segment extending from the second end; and a non-planar segment connecting the first end to the second end;

wherein the support lever is configured to deform the metal dome when the support lever is depressed from above; and a key cap disposed over and rigidly adhered to the second end of the support lever.

19. The keyboard of claim 18, wherein the support lever includes an elastomeric component positioned over the metal dome, wherein the elastomeric spacer is configured to contact and deform the metal dome when the support lever is depressed from above.

20. The keyboard of claim 18, wherein the support lever is formed of a rigid material and is pivotally coupled to the first substrate.

21. The keyboard of claim 18, wherein the support lever is formed of a flexible material and is fixedly coupled to the first substrate.

22. The keyboard of claim 18, wherein the membranes and support levers are interwoven.

23. The tactile low-travel keyboard of claim 18, wherein the key cap has a substantially flat top surface and a substantially flat bottom surface.

24. The keyboard of claim 18, wherein the metal dome comprises stainless steel.

25. The keyboard of claim 18, wherein some of the support levers are curved.

* * * * *